United States Patent [19]

Pechar

[11] Patent Number: 4,844,522

[45] Date of Patent: Jul. 4, 1989

[54] LATCH ASSEMBLY

[75] Inventor: Stanley Pechar, Diamond Bar, Calif.

[73] Assignee: Kwikset Corporation, Anaheim, Calif.

[21] Appl. No.: 116,600

[22] Filed: Nov. 2, 1987

[51] Int. Cl.[4] ..... E05C 1/16

[52] U.S. Cl. ..... 292/169; 292/244; 292/377; 292/DIG. 60

[58] Field of Search ..... 292/244, 245, 169 R, 292/337, DIG. 60, 169.23, 169.13, 167, 170, 171

[56] References Cited

U.S. PATENT DOCUMENTS

| | | | |
|---|---|---|---|
| 1,739,654 | 12/1929 | Schlage | 292/167 |
| 1,876,080 | 9/1932 | Schlage | 70/151 R |
| 1,876,081 | 9/1932 | Schlage | 70/151 R |
| 2,307,038 | 1/1943 | Gutman | 292/167 |
| 2,516,991 | 8/1950 | Heyer | 292/244 |
| 2,613,094 | 10/1952 | Schlage | 297/244 |
| 2,803,481 | 8/1957 | Williams et al. | 292/245 |
| 4,040,652 | 8/1977 | Arfelt et al. | 292/170 |
| 4,052,092 | 10/1977 | Bergen | 292/244 |
| 4,516,798 | 5/1985 | Bergen | 292/169.13 |
| 4,750,766 | 6/1988 | Shen | 292/169.14 |

FOREIGN PATENT DOCUMENTS

| | | | |
|---|---|---|---|
| 522128 | 8/1953 | Belgium | 292/245 |

*Primary Examiner*—Gary L. Smith
*Assistant Examiner*—Eric K. Nicholson
*Attorney, Agent, or Firm*—Barry E. Deutsch

[57] ABSTRACT

A latch assembly for a lock adaptable for use with inswinging, outswinging, right hand and left hand mounted doors includes a latchcase assembly having a vertically extending slot. A bolt is mounted for sliding movement within the latchcase. A first rotatable cam having a hub is mounted within the vertical slot of said latchcase assembly for sliding the bolt between bolt engaged and disengaged positions. The height of the latchcase slot is larger then the diameter of the hub portion of the cam to accommodate limited vertical movement of the cam within the slot. The vertical position of the cam is shifted within the vertical slot to maintain the horizontal center line of the cam in a predetermined spaced vertical position relative to the horizontal center line of the bolt.

7 Claims, 5 Drawing Sheets

FIG. 4
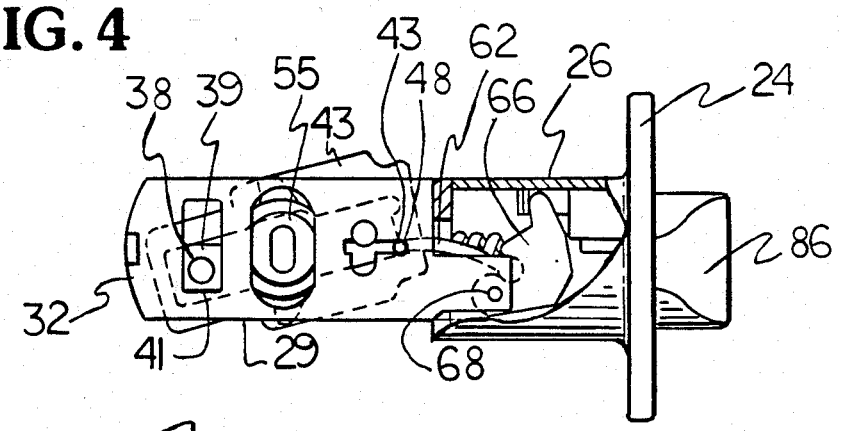
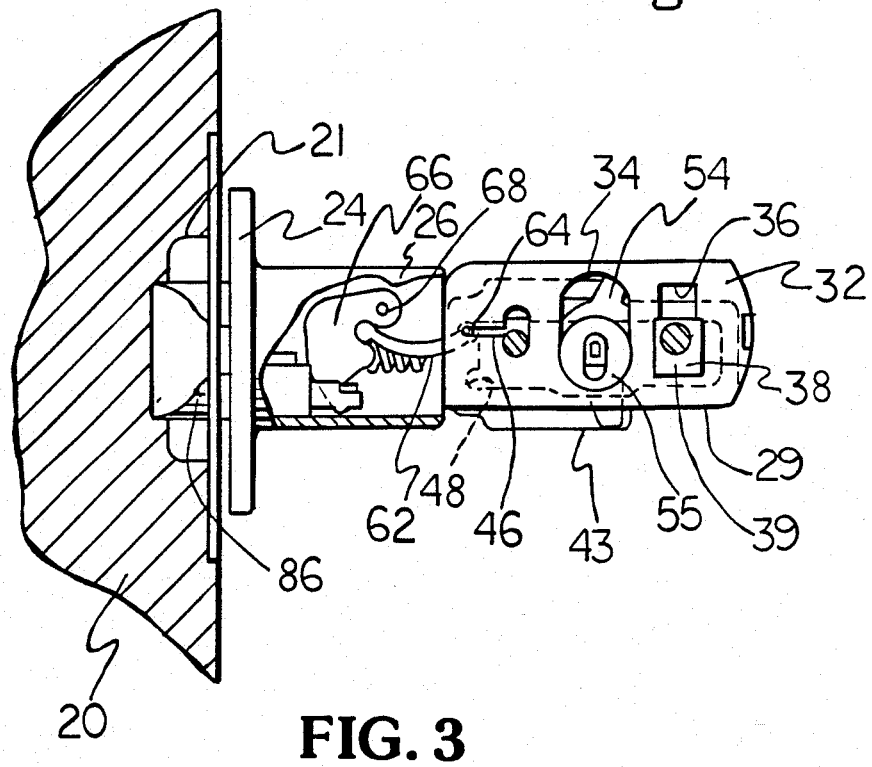
FIG. 3

LATCH ASSEMBLY

BACKGROUND OF THE INVENTION

This invention relates to a latch assembly usable with a lock adaptable for use on inswinging outswinging, right handed and left handed mounted doors, and in particular to a latch assembly wherein the latch will always retract the bolt irrespective of the direction the hand operator is rotated and wherein the bolt may be extended to a deadlatch position.

Doors controlling ingress and egress to and from a room or similar space may be either left hand or right hand mounted, that is to say the hinges of the door may be located at the door's left edge (left hand mounted) or the hinges may be mounted at the right edge of the door (right hand mounted). In addition, doors may be either outswinging or inswinging, that is to say that the doors are designed to close on outward movement of the door relative to the occupied space (inswinging) or designed to close on inward movement of the door relative to the occupied space (outswinging). Thus, it is readily apparent that there are four possible mounting schemes for doors.

In some instances, latch assemblies that are usable with one or more combinations of door mountings may not be usable with one or more of the other possible combinations of door mountings. The foregoing requires manufacturers and sellers of such latch assemblies to maintain separate inventories of latches to accommodate all four door mountings, and in addition, requires the purchaser of the latch assemblies to be knowledgeable with respect to the specific door mounting. Most consumers are not so knowledgeable and in instances where the same latch assembly can not be used for all four door mountings, it is just as likely that the consumer will obtain the wrong latch assembly as the correct one.

Latch assemblies are typically designed to either be extendable within the door strike for ¾ of an inch or 1 inch (known as the deadlatch position). Further, latch assemblies may be designed to either retract the bolt of the assembly when the operator (a key, thumbpiece, doorknob, lever, or the like) is rotated in a first direction , or may be designed so that the bolt is retracted by the latch when the operator is rotated in either a clockwise or counterclockwise direction. The problem discussed above with respect to latch assemblies and the four types of door mountings, is particularly manifested in latchbolt assemblies wherein the bolt is extendable into a deadlatch position and the latch is operable to retract the bolt when the operator is rotated in either a clockwise or counterclockwise direction.

It is accordingly an object of the present invention to manufacture a single latchbolt assembly which can be used with either inswinging, outswinging, right hand or left hand mounted doors. It is a further object of the present invention to provide a single latch assembly capable of use with any door mounting and wherein the latchbolt can be placed in a deadlatch position and the latch will always retract the bolt irrespective of the direction of rotation of the operator.

SUMMARY OF THE INVENTION

The foregoing objects and other objects of the invention are attained in a latch assembly for a lockset adaptable for use with inswinging, outswinging, right hand and left hand mounted doors, said assembly including housing means defining a latchcase and including a vertically extending slot; a bolt mounted for sliding movement within said latchcase; a first rotatable cam mounted within the vertical slot of said latchcase for sliding said bolt between bolt engaged and disengaged positions, with the height of the latchcase slot being larger than the diameter of the hub portion of the cam to accommodate limited vertical movement of the cam within the slot; and means for shifting the cam within the vertical slot to maintain the horizontal center line of the cam in a predetermined spaced vertical position relative to the center line of the bolt.

BRIEF DESCRIPTION OF THE DRAWING

FIG. 3 is an elevation view, partially in section, of a latch assembly in accordance with the present invention when installed within a door;

FIGS. 4–7 are elevation views of the latch assembly, partially in section, illustrating the various elements of the latch assembly as the latch assembly is changed from being suitable for mounting on a door such as that illustrated in FIG. 3 (a right hand door) to a latch assembly capable for use with a left hand mounted door.

DESCRIPTION OF THE PREFERRED EMBODIMENT

Figure 1:
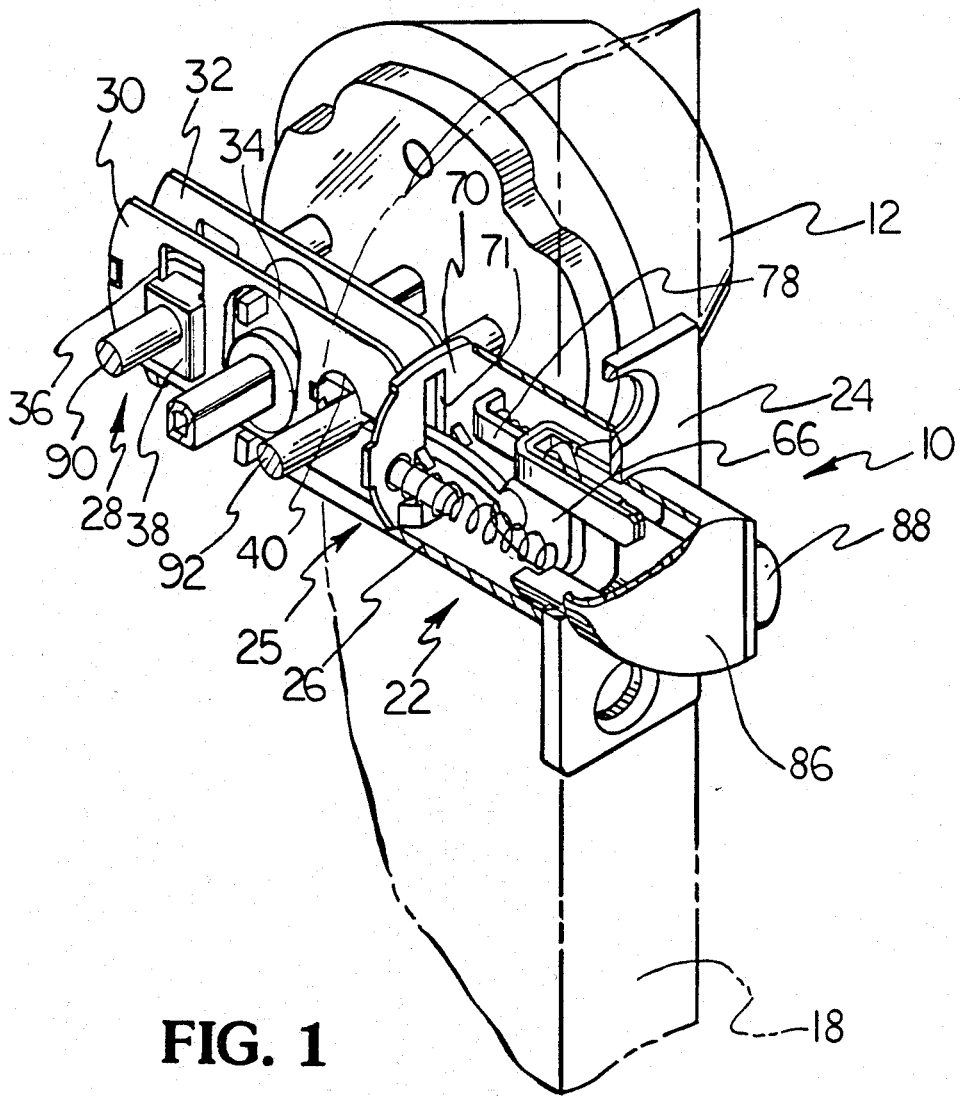
FIG. 1 of the drawing illustrates a perspective view of the latch assembly of the present invention, with a portion of the lockset and door in which the latch assembly is mounted being shown in phantom.

Referring now to the various figures of the drawing, there is a disclosed a preferred embodiment of the present invention. In referring to the various figures, like numerals shall refer to like parts.

Figure 2:
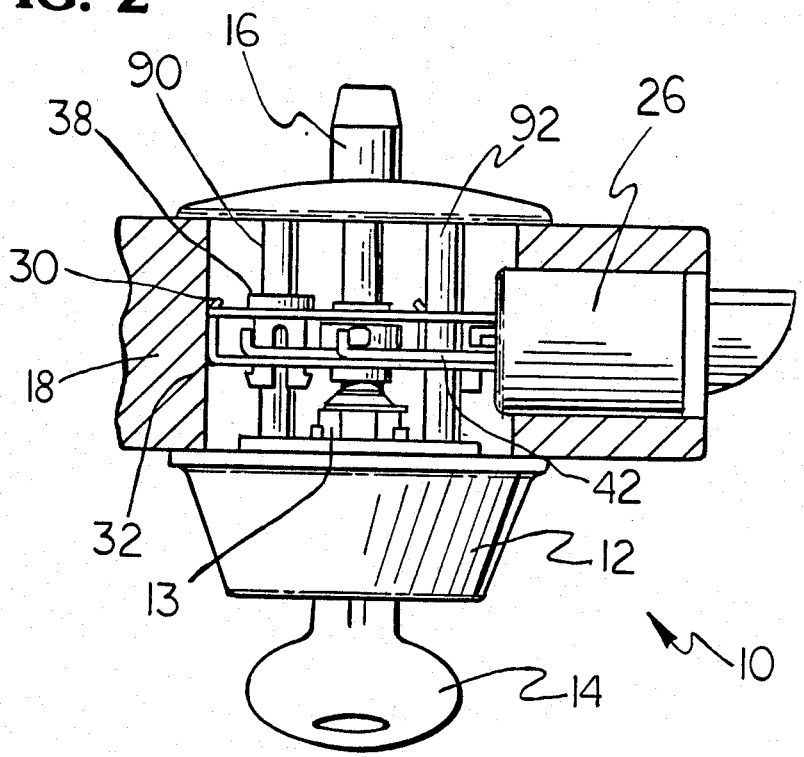
FIG. 2 is a horizontal sectional view of the lockset installed within a door illustrating further details of the present invention.
Figure 8:
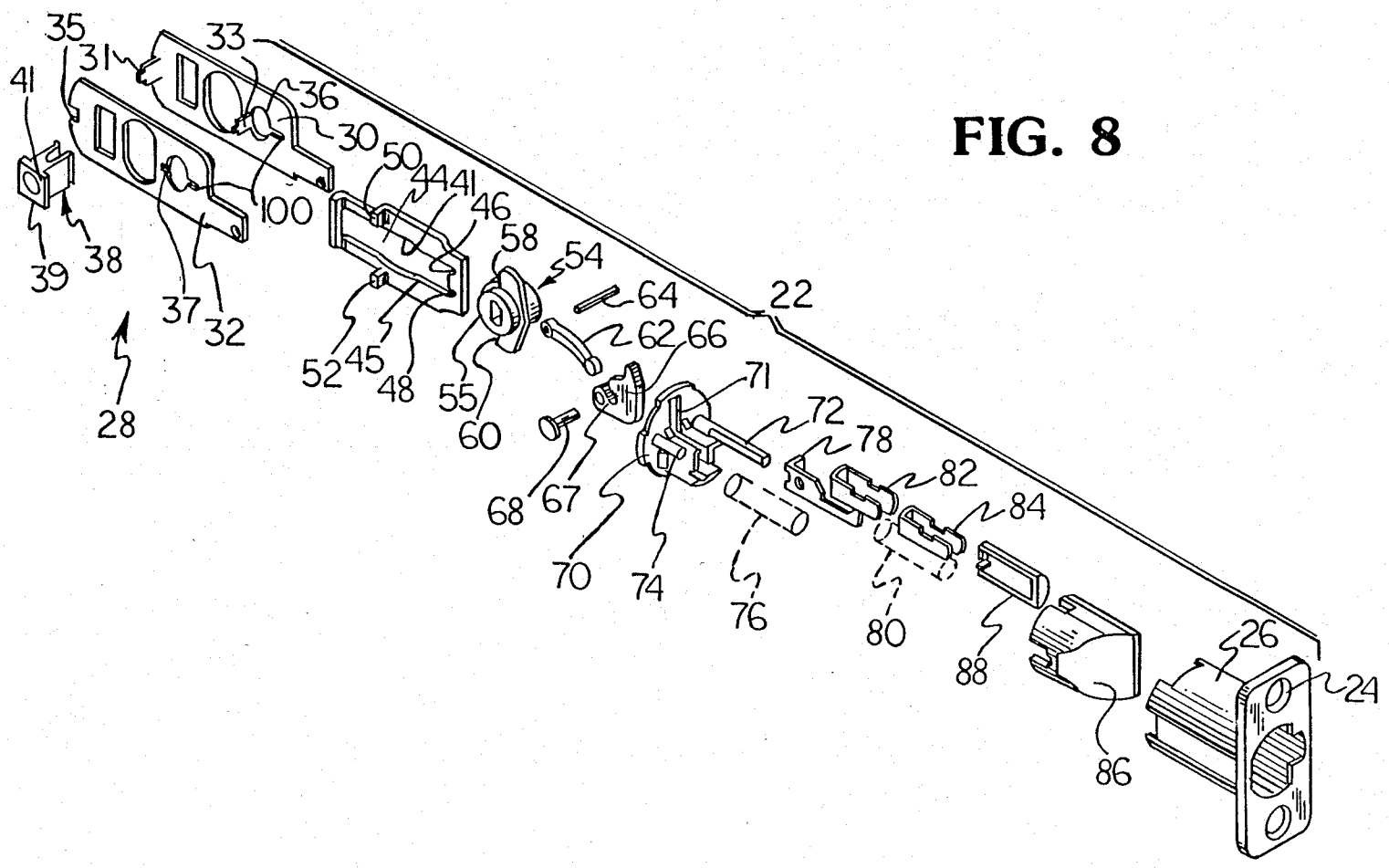
FIG. 8 is an exploded isometric view of the latchbolt assembly of the present invention.

Referring particularly to FIGS. 1, 2 and 8, there is disclosed a lockset 10 having an outside hand operator 12 including a standard cylinder plug 13 (illustrated in FIG. 2). Outside operator 12 is illustrated as being operated by key 14. The lockset further includes an inside hand operator 16 which is illustrated as being actuated by a thumbpiece, however as is known in the art, the operator may also be actuated by a handle, knob, lever, or similar device. The foregoing is all conventional within the art.

Lockset 10 is mounted on a door 18 which is movable relative to doorjamb 20. As illustrated in FIG. 3, the door on which the lockset is mounted is a right hand door, that is the hinges of the door are located at the right edge thereof. The door is also inswinging, that is the bolt of the lockset will close on outward movement of the door relative to the room or other space located adjacent to the door.

Lockset 10 includes a latchset assembly 22. The latchset assembly comprises a latchfront 24 suitably joined to latchcase 26 of latchcase assembly 25. The latchcase assembly further includes latchcase extension 28 comprising a pair of spaced plates 30, 32. Each of the plates includes a vertically extending slot 34. Plates 30, 32 also include a second somewhat smaller vertical slot 36 and a somewhat circular opening 40. Each of the plates also includes an elongated slot 100.

A screw guide 38 is removably insertable into slot 36. Preferably screw guide 38 is formed from plastic or similar somewhat resilient material. The guide includes a relatively thick bottom wall portion 39 and a relatively thin top wall portion 41 for a reason to be more fully described hereinafter. Screw guide 38 and opening 40 are provided to receive screws 90, 92 which are used to mount the lockset in door 18.

One of the pair of plates 30, 32, for example plate 30, includes a pair of fingers 31, 33, which extends towards the other of the plates 32. Plate 32 includes a notch 35 which receives finger 31. Finger 35 fits within a mating notch 37 formed at the left side of opening 40 as viewed in FIG. 8. The relationship of fingers 31, 33, and notches 35 and 37 provide means for joining plates 30, 32, in spaced relationship with respect to each other.

A slide plate 42 is positioned in the opening formed between plates 30, 32 for relative movement with respect to the plates. Slide plate 42 includes wall means 41 defining an elongated longitudinally extending slot 44. Slot 44 includes a contoured portion 45. The forward end of the wall means includes a pair of notches 46, 48. Notch 46 is disposed vertically above the horizontal center line of the slide plate whereas notch 48 is disposed vertically below the horizontal center line. Plate 42 further includes a pair of inwardly extending fingers 50, 52. A cam 54 is rotatably received within the contoured portion 45 of longitudinal slot 44. Cam 54 includes hub 55 having bearing surface 56 which is in actual engagement with wall means 41 defining contoured portion 45. Cam 54 further includes radially extending ears 58, 60. As viewed in FIG. 8, ear 58 will engage finger 50 when cam 54 is rotated in a counterclockwise direction and ear 60 will engage finger 52 when the cam is rotated in a clockwise direction. Engagement of either of the ears with either of the fingers will cause slide plate 42 to move rearwardly with respect to plates 30, 32.

Assembly 22 further includes a link 62 having a link pin 64 extending from one end thereof. Pin 64 is supported at each end within slot 100 of plates 30, 32 and in turn supports plate 42 by emplacement within a selected one of the notches 46, 48 so that the horizontal center line of the slide plate 42 is maintained in spaced vertical relation to the horizontal center line of the latch assembly. The other end of link 62 is disposed within a groove 67 of a second rotatable cam 66. Cam 66 is rotatable about pin 68, Cam 66 extends through an opening 71 formed in latch carrier 70. The latch carrier includes a pair of longitudinally extending rods 72 and 74. Rod 72 mounts locking dog 78 and locking dog spring 80 thereon. Rod 74 mounts bolt spring 76 thereon.

Assembly 22 further includes main bolt 86 and auxiliary bolt 88 mounted for sliding movement within latchcase 26, and bolt extension 87 and unlocking slide 84 movable relative thereto. The manner in which auxiliary bolt 88, main bolt 86, locking dog 78, bolt entension 82 and unlocking slide 84 function during retraction of bolts 86 and 88 is more fully disclosed in issued U.S. Pat. No. 4,516,798 issued May 14, 1985 in the name of Gary R. Bergen and assigned to the same assignee as the assignee hereof.

With reference to FIG. 3, the latch assembly 22 is illustrated as mounted on a right hand door (not shown), that is the hinges of the door would be located at the right hand side of the drawing. Bolt 86 extends within a standard strike 21 formed in doorjamb 20. The particular application illustrated in FIG. 3 is not only a right hand door, but it is also inswinging, that is the door is designed to close upon outward movement of the door relative to the space for which the door is used to control ingress and egress. Doors may also be left hand mounted and may also be designated as outswinging; thus there are four combinations of possible mountings for a door. Not all latch assemblies can be used with all types of door mountings; thus, manufacturers and sellers of latch assemblies not suitable for use with all four types of door mountings must produce and maintain essentially duplicate inventories. This is relatively expensive and further, since consumers are not always knowledgeable with respect to the specific type of door mounting they are as likely to obtain an incorrect latch assembly as a correct one. The specific problem is particularly manifested in deadlatch assemblies wherein bolt retraction occurs irrespective of the direction of rotation of the outside hand operator or inside hand operator. Extension of the main bolt into a deadlatch position requires the main bolt to be fully extended within the door strike. Typical latches require only ½ of an inch extension. To obtain the full throw required to achieve the ½ inch bolt extension, the horizontal center line of the cam must be maintained in vertically spaced relation relative to the horizontal center line of the bolt. Particular complications are developed in designing a latch assembly usable with doors mounted in any one of the four described ways wherein the bolt is extendable into a deadlatch position and is retractable irrespective of the direction of rotation of either the inside operator or the outside operator.

Referring again to FIG. 3, let us assume, that a consumer has obtained latch assembly 22 which as illustrated is designed for mounting on a right hand inswinging door. Let us further assume that in reality, the consumer wishes to mount the latch assembly on a left hand inswinging door. Latch assembly 22 of the present invention readily accommodates both mounting arrangements. With reference to FIG. 3, it should be observed that link pin 64 is supported within the upper notch 46 of slide plate 42. The bottom wall 43 of slide plate 42 is substantially parallel to the bottom wall 29 of plates 30 and 32. The horizontal center line of cam 54 is disposed in vertically spaced relation beneath the horizontal center line of bolt 86. The thick wall portion 39 of screw guide 38 faces towards bottom wall 29 of plates 30, 32. Screws 90, 92 fall on the same horizontal center line, which center line is positioned vertically between the horizontal center line of bolt 86 and the horizontal center line of cam 54.

To accommodate mounting on a left hand inswinging door, latch assembly 22 is rotated 180 degrees about its horizontal axis and thus assumes the position illustrated in FIG. 4. In the position illustrated in FIG. 4, link pin 64 is now supported within the lower notch, although in reality such notch is actually the same notch as the notch illustrated in FIG. 3. That is to say, pin 64 remains in notch 46. The bottom wall of slide plate 42 is no longer parallel to the bottom wall of plates 30, 32 but is now canted relative thereto. The openings for receiving screws 90, 92 i.e. screw guide 38 and opening 40 are no longer positioned on the same horizontal center line, but rather the opening defined by screw guide 38 is spaced vertically beneath the opening 40. The horizontal center line of cam 54 is now positioned somewhat above the horizontal center line of bolt 86. However, since slide plate 42 is now canted relative to plates 30, 32, the cam 54 cannot be effectively used to retract bolt 86.

Figure 6:
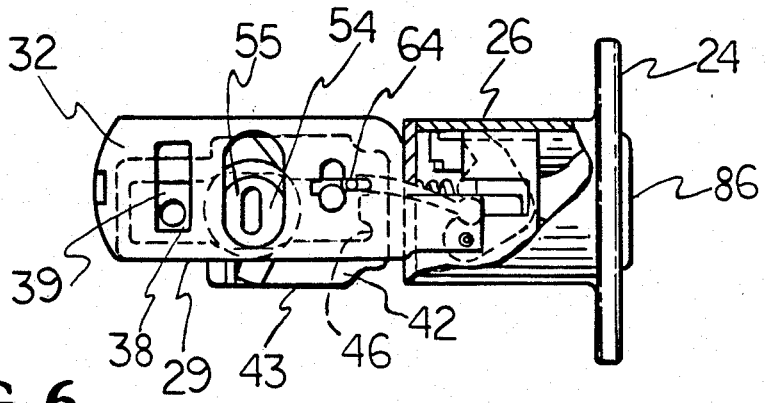
Figure 5:
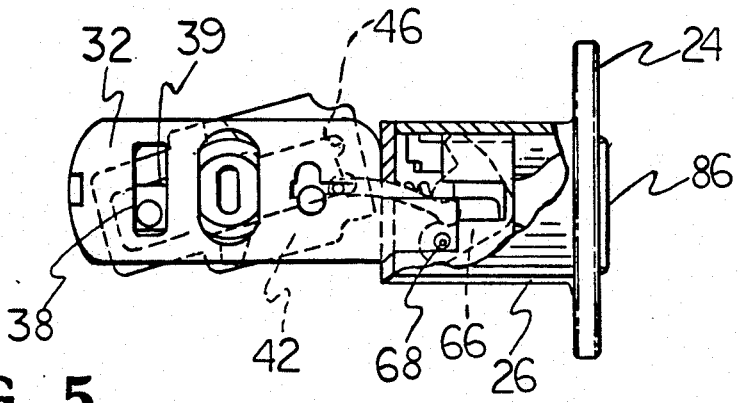

The parts of latch assembly 22 can be quickly readjusted to make the latch assembly usable with a left hand, inswinging door. Referring specifically to FIG. 5, it will be noted that bolt 86 has been placed in its retracted position. The movement of bolt 86 towards its retracted position, pivots cam 66 and link 62 counterclockwise which in turn moves link pin 64 to the rear of latch assembly 22 relative to notch 46. In the position illustrated in FIG. 5, the link pin 64 is no longer supported within the notch and thus slide plate 42 will fall vertically downward due to its own weight. The slide plate now assumes the position illustrated in FIG. 6. It will be observed that the bottom wall of the slide plate is parallel to the bottom wall of plates 30, 32 and that cam 54 has been shifted vertically downward within slot 34 so that the horizontal center line of the cam is again spaced vertically beneath the horizontal center line of the bolt. It should also be observed that the opening defined by screw guide 38 is still horizontally misaligned with respect to opening 40.

Figure 7:
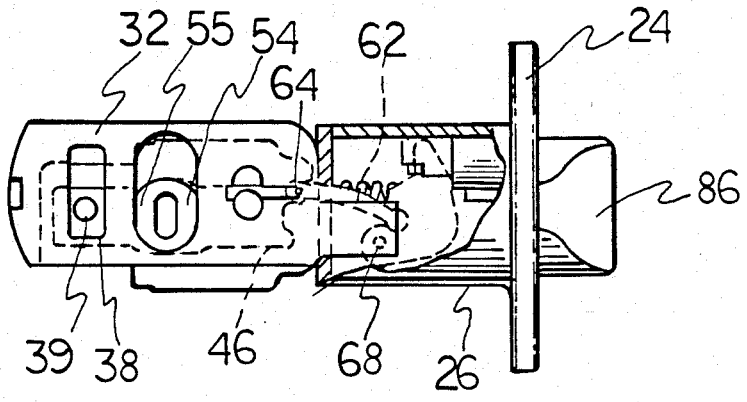

With reference to FIG. 7, it will be observed that bolt 86 is again in its fully extended position which has caused cam 64 and link 62 to rotate in a clockwise direction moving link pin 64 forwardly within notch 48. This arrangement retains slide plate 42 in the illustrated position. It will also be observed that screw guide 38 has been removed and reinserted within vertical slot 36 so that thick wall portion 39 of the screw guide is again facing downwardly. The repositioning of the screw guide within slot 36 reorients the horizontal axes of the screw guide relative to opening 40 so that horizontal axis are in alignment. Latch assembly 22 illustrated in FIG. 7 is again fully operational and ready to be mounted in a lockset used on a left hand, inswinging door.

As may be readily recognized, the latch assembly of the present invention can be quickly and easily readjusted to accommodate either right hand inswinging or left hand inswinging doors. Similarly, the latch assembly can also be readily adjusted to accommodate right hand outswinging and left hand outswinging doors.

While a preferred embodiment of the present invention has been described and illustrated, the invention should not be limited thereto but may be otherwise embodied within the scope of the following claims.

What is claimed is:

1. A latch assembly for a lock adaptable for use with inswinging, outswinging, right hand and left hand mounted doors, said assembly including:

housing means defining a latchcase assembly and including a vertically extending slot;

a bolt mounted for sliding movement within said latchcase assembly;

a first rotatable cam having a generally cylindrical hub portion mounted within the vertical slot of said latchcase assembly for sliding said bolt between bolt engaged and disengaged positions, with the height of the latchcase assembly slot being greater than the diameter of the hub portion of the cam to accommodate limited vertical movement of the cam within the slot; and means for shifting the cam within the vertical slot to maintain the horizontal center line of the cam in a predetermined spaced vertical position relative to the horizontal center line of the bolt, said shifting means comprising a sliding plate mounted for movement relative to said latchcase assembly and including means defining a longitudinally extending slot functioning as a bearing surface for said cam hub portion, with the sliding plate being movable with said cam as the cam is shifted within the vertical slot of said latchcase assembly, said sliding plate having at least one finger extending towards said rotatable cam and selectively engagable therewith, with rotation of said cam into engagement with said finger resulting in sliding movement of said plate relative to said latchcase assembly.

2. A latch assembly in accordance with claim 1 wherein said sliding plate includes first and second wall means defining vertically spaced notches formed at one end, with the notch defining wall means extending equal distance vertically above and below the horizontal center line of said bolt, and a link member having a pin extending from one end and extending within a selected one of said notches for maintaining the horizontal center line of said plate in spaced relation to the horizontal center line of said bolt; and a second cam connected to the other end of said link and pivotal in response to movement of said bolt.

3. A latch assembly in accordance with claim 2 wherein said latchcase assembly includes a second vertically extending slot; and means defining a screw guide removably insertable into said second vertically extending latchcase slot.

4. A latch assembly in accordance with claim 3 wherein said sliding plate includes a second finger vertically spaced from said first finger, with said cam being rotatable into engagement with said first finger when rotated in a clockwise direction and being engageable with said second finger when rotated in a counterclockwise direction.

5. A latch assembly in accordance with claim 1 wherein said latchcase assembly includes a second vertically extending slot; and means defining a screw guide removably insertable into said second vertically extending latchcase slot.

6. A latch assembly in accordance with claim 5 wherein said sliding plate includes a second finger vertically spaced from said first finger, with said cam being rotatable into engagement with said first finger when rotated in a clockwise direction and being engageable with said second finger when rotated in a counterclockwise direction.

7. A latch assembly in accordance with claim 2 wherein said sliding plate includes a second finger vertically spaced from said first finger, with said cam being rotatable into engagement with said first finger hen rotated in a clockwise direction and being engageable with said second finger when rotated in a counterclockwise direction.

* * * * *